US008708769B2

(12) United States Patent
De La Torre et al.

(10) Patent No.: US 8,708,769 B2
(45) Date of Patent: Apr. 29, 2014

(54) TOY

(75) Inventors: Gabriel De La Torre, Bell Gardens, CA (US); Jian Sheng Hu, Guangzhou (CN); Josiah To Sang Li, Monterey Park, CA (US); Wai Nang Lam, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 732 days.

(21) Appl. No.: 12/902,602

(22) Filed: Oct. 12, 2010

(65) Prior Publication Data

US 2011/0086572 A1 Apr. 14, 2011

Related U.S. Application Data

(60) Provisional application No. 61/250,507, filed on Oct. 10, 2009.

(51) Int. Cl.

| | |
|---|---|
| ***A63H 13/10*** | (2006.01) |
| ***A63H 13/00*** | (2006.01) |
| ***A63H 3/20*** | (2006.01) |

(52) U.S. Cl.
USPC ..... 446/308; 446/330

(58) Field of Classification Search
USPC ..... 446/268, 308, 321, 330, 340, 376, 390, 446/429
See application file for complete search history.

(56) References Cited

U.S. PATENT DOCUMENTS

| | | | | | |
|---|---|---|---|---|---|
| 1,982,491 | A | * | 11/1934 | Barnum | 273/317.3 |
| 2,151,546 | A | * | 3/1939 | Arnold | 446/308 |
| 2,185,091 | A | * | 12/1939 | Orlando et al. | 446/308 |
| 2,296,541 | A | * | 9/1942 | Schuyler | 40/419 |
| 2,799,501 | A | * | 7/1957 | Barbolla | 273/317.3 |
| 2,827,035 | A | * | 3/1958 | Modica, Jr. | 124/4 |
| 2,911,758 | A | * | 11/1959 | Carson | 446/308 |
| 3,411,237 | A | * | 11/1968 | Crosman | 446/132 |
| 3,425,153 | A | * | 2/1969 | Crosman et al. | 446/308 |
| 3,452,472 | A | * | 7/1969 | Glass et al. | 446/336 |
| 3,565,537 | A | * | 2/1971 | Tepper et al. | 356/246 |
| 3,751,849 | A | * | 8/1973 | Goldfarb et al. | 446/246 |
| 3,844,061 | A | * | 10/1974 | Goldfarb et al. | 446/365 |

(Continued)

FOREIGN PATENT DOCUMENTS

| | | | |
|---|---|---|---|
| FR | 2259633 | A * | 10/1975 |
| JP | 06-26993 | | 4/1994 |

(Continued)

OTHER PUBLICATIONS

English Abstract for JP2000061168 (A).

(Continued)

*Primary Examiner* — Gene Kim
*Assistant Examiner* — Alyssa Hylinski
(74) *Attorney, Agent, or Firm* — Cantor Colburn LLP

(57) ABSTRACT

A toy figure is disclosed herein, the toy figure having a main body portion; a pair of appendages movably secured to the main body portion for movement from a first position to a second position and back to the first position; and a removably body portion removably secured to the main body portion, wherein the pair of appendages grasp the removably body portion when they are moved to the second position and the removably body portion is removably secured to the main body portion, wherein the removably body portion is subsequently removed from the main body portion by the pair of appendages as they are moved back towards the first position from the second position.

16 Claims, 9 Drawing Sheets

(56) References Cited

U.S. PATENT DOCUMENTS

| | | | | | |
|---|---|---|---|---|---|
| 3,906,661 | A | | 9/1975 | Weiser | |
| 3,955,311 | A | | 5/1976 | Lyons et al. | |
| 4,095,367 | A | | 6/1978 | Ogawa | |
| 4,118,888 | A | * | 10/1978 | Ogawa | 446/92 |
| 4,120,117 | A | * | 10/1978 | Terzian et al. | 446/308 |
| 4,183,173 | A | | 1/1980 | Ogawa | |
| 4,206,564 | A | | 6/1980 | Ogawa | |
| 4,214,402 | A | | 7/1980 | Ogawa | |
| 4,236,345 | A | | 12/1980 | Inoue | |
| 4,248,006 | A | | 2/1981 | Jones et al. | |
| 4,262,445 | A | * | 4/1981 | Orenstein | 446/308 |
| 4,307,533 | A | | 12/1981 | Sims et al. | |
| 4,382,347 | A | | 5/1983 | Murakami | |
| 4,391,060 | A | | 7/1983 | Nakane | |
| 4,516,948 | A | | 5/1985 | Obara | |
| 4,530,670 | A | | 7/1985 | Ohno | |
| 4,569,666 | A | | 2/1986 | Wolf | |
| 4,575,352 | A | | 3/1986 | Matsuda | |
| 4,583,958 | A | | 4/1986 | Matsuda | |
| 4,599,078 | A | | 7/1986 | Obara | |
| 4,626,222 | A | | 12/1986 | Sweet | |
| 4,642,064 | A | | 2/1987 | Yoke | |
| 4,655,725 | A | | 4/1987 | Torres | |
| 4,689,034 | A | * | 8/1987 | Dubois et al. | 446/309 |
| 4,710,146 | A | * | 12/1987 | Rasmussen et al. | 446/308 |
| 4,723,931 | A | | 2/1988 | Allen et al. | |
| 4,738,649 | A | | 4/1988 | Delli Bovi et al. | |
| 4,802,878 | A | * | 2/1989 | Terzian et al. | 446/300 |
| 4,985,008 | A | | 1/1991 | Price | |
| 5,478,269 | A | | 12/1995 | Wolfram | |
| 5,701,878 | A | * | 12/1997 | Moore et al. | 124/67 |
| 5,730,638 | A | | 3/1998 | Ward | |
| 5,810,638 | A | | 9/1998 | Wood | |
| 5,924,910 | A | | 7/1999 | Liu | |
| 6,086,446 | A | * | 7/2000 | Arriola | 446/376 |
| 6,152,799 | A | * | 11/2000 | Arriola | 446/330 |
| 6,171,169 | B1 | * | 1/2001 | Saunders | 446/308 |
| 6,224,455 | B1 | * | 5/2001 | Laurienzo | 446/297 |
| 6,280,285 | B1 | | 8/2001 | Morehouse | |
| 6,527,619 | B1 | | 3/2003 | Agostini et al. | |
| 6,699,096 | B2 | | 3/2004 | Christopherson et al. | |
| 6,755,716 | B2 | | 6/2004 | Agostini et al. | |
| 6,824,442 | B2 | | 11/2004 | Andrews et al. | |
| 6,837,769 | B1 | * | 1/2005 | Skov et al. | 446/139 |
| 7,121,917 | B2 | | 10/2006 | Hardouin et al. | |
| 7,192,331 | B1 | | 3/2007 | Ward | |
| 7,537,506 | B2 | | 5/2009 | de la Torre | |
| 7,575,496 | B2 | | 8/2009 | Lau et al. | |
| 7,934,973 | B2 | * | 5/2011 | Trageser et al. | 446/199 |
| 2006/0234599 | A1 | | 10/2006 | Mo et al. | |
| 2006/0270310 | A1 | | 11/2006 | Campbell et al. | |
| 2006/0270320 | A1 | | 11/2006 | Proch | |
| 2006/0292963 | A1 | | 12/2006 | Sun et al. | |
| 2006/0292965 | A1 | | 12/2006 | Strauss | |
| 2008/0064293 | A1 | | 3/2008 | Wade | |
| 2009/0075555 | A1 | | 3/2009 | Barthold | |
| 2009/0075556 | A1 | | 3/2009 | Sun et al. | |
| 2009/0075559 | A1 | | 3/2009 | Barthold | |
| 2009/0117820 | A1 | | 5/2009 | Willett et al. | |

FOREIGN PATENT DOCUMENTS

| | | | |
|---|---|---|---|
| JP | 9299623 | A | 11/1997 |
| JP | 2000061168 | A | 2/2000 |
| JP | 2006051054 | A | 2/2006 |
| WO | 2007128999 | A2 | 11/2007 |

OTHER PUBLICATIONS

English Abstract for JP9299623 (A).
English Abstract for JP2006051054 (A).
International Search Report or International Application No. PCT/US2010/052277; International Filing Date: Oct. 12, 2010; Date of Mailing: Jun. 30, 2011.
Written Opinion for Intenational Application No. PCT/US2010/052277; International Filing Date: Oct. 12, 2010; Date of Mailing: Jun. 30, 2011.

* cited by examiner

TOY

CROSS REFERENCE TO RELATED APPLICATIONS

This application claims the benefit of U.S. provisional patent application Ser. No. 61/250,507 filed on Oct. 10, 2009 the contents of which are incorporated herein by reference thereto.

BACKGROUND

Various embodiments of the present invention relate to a toy and more particularly, a toy figure having articulating portions.

Children's toys have included miniature cars, boats, trains, figures, etc. wherein the user's imagination provides for hours of extended play and enjoyment. Toy figures that resemble fighting or combat type activities are particularly popular as the user can participate in imaginary battles or action sequences.

Accordingly, it is desirable to provide a toy that has articulating portions and allows for interaction with the user.

SUMMARY OF THE INVENTION

In one embodiment, a toy figure is provided, the toy figure having a main body portion; a pair of appendages movably secured to the main body portion for movement from a first position to a second position and back to the first position; and a removably body portion removably secured to the main body portion, wherein the pair of appendages grasp the removably body portion when they are moved to the second position and the removably body portion is removably secured to the main body portion, wherein the removably body portion is subsequently removed from the main body portion by the pair of appendages as they are moved back towards the first position from the second position.

In another embodiment, a toy figure is provided, the toy figure having: a main body portion; a pair of arms movably secured to the main body portion for movement between a first position and a second position, each of the pair of arms having an upper arm portion pivotally secured to the main body portion and a pair of lower arm portions each being pivotally secured to the upper arm portion; and a removable body portion fixedly secured to the pair of arms, the removably body portion being configured to be received within an area of main body portion when the pair of arms are in the second position and wherein the removable body portion is removed from the main body portion when the pair of arms are in the first position.

BRIEF DESCRIPTION OF THE DRAWINGS

Other features, advantages and details appear, by way of example only, in the following description of embodiments, the description referring to the drawings in which.

DETAILED DESCRIPTION

Figure 10:
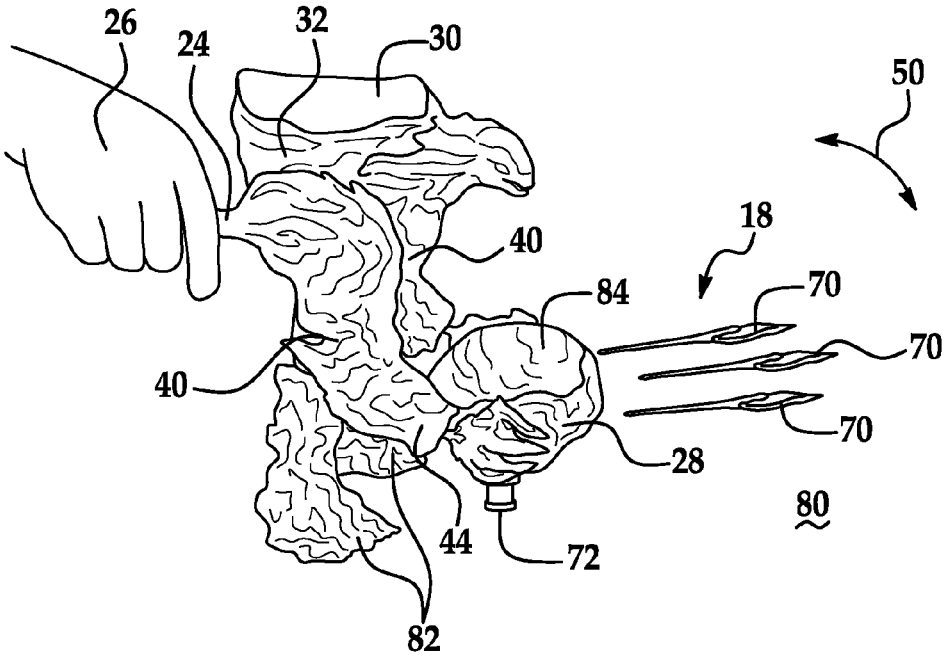
Figure 11:
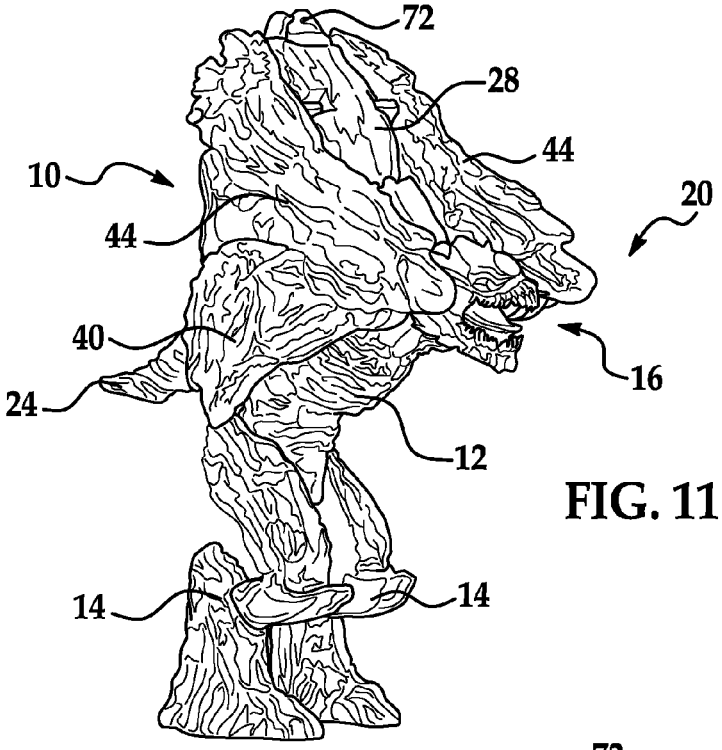
FIGS. 11-16 illustrate an alternative exemplary embodiment of the present invention.
Figure 12:
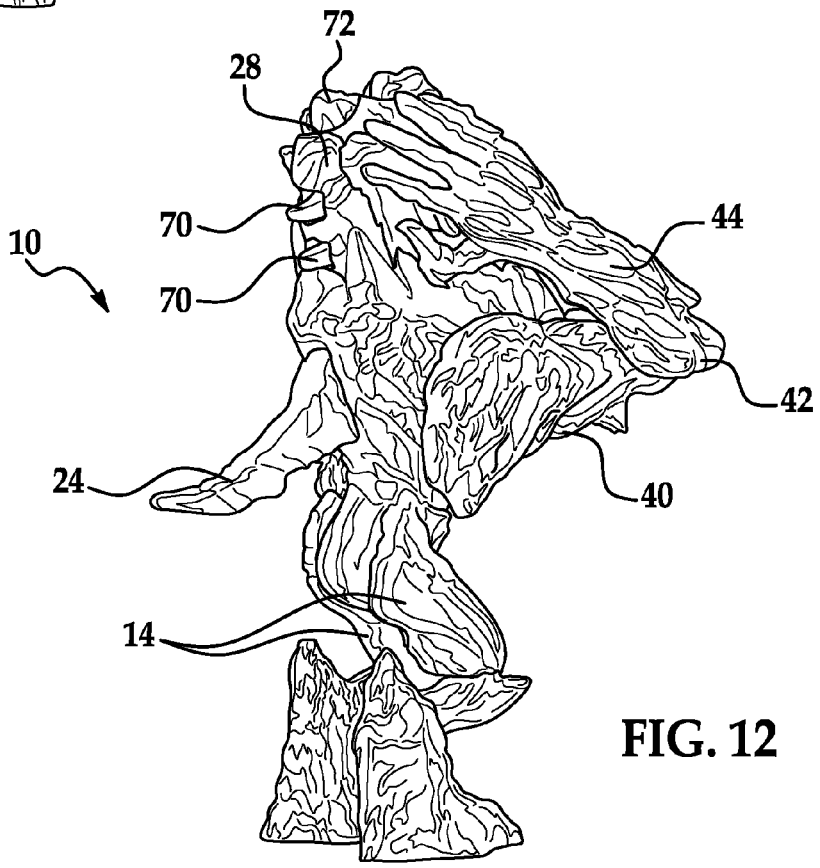
Figure 13:
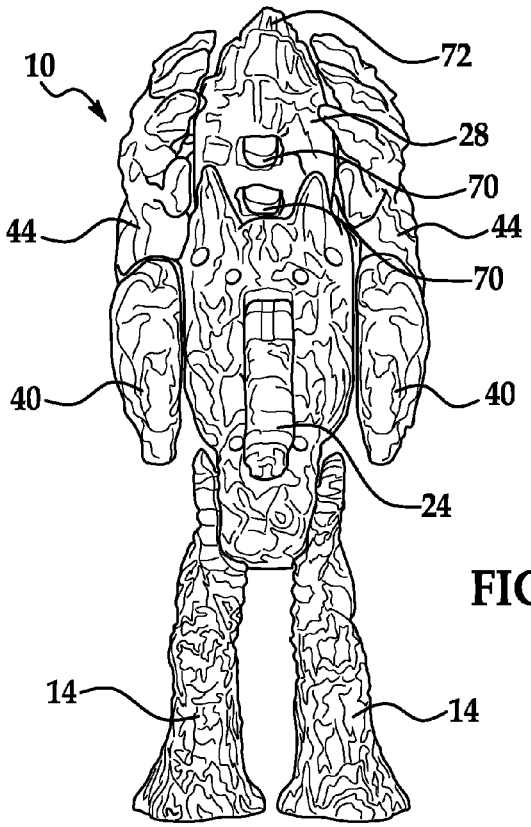
Figure 14:
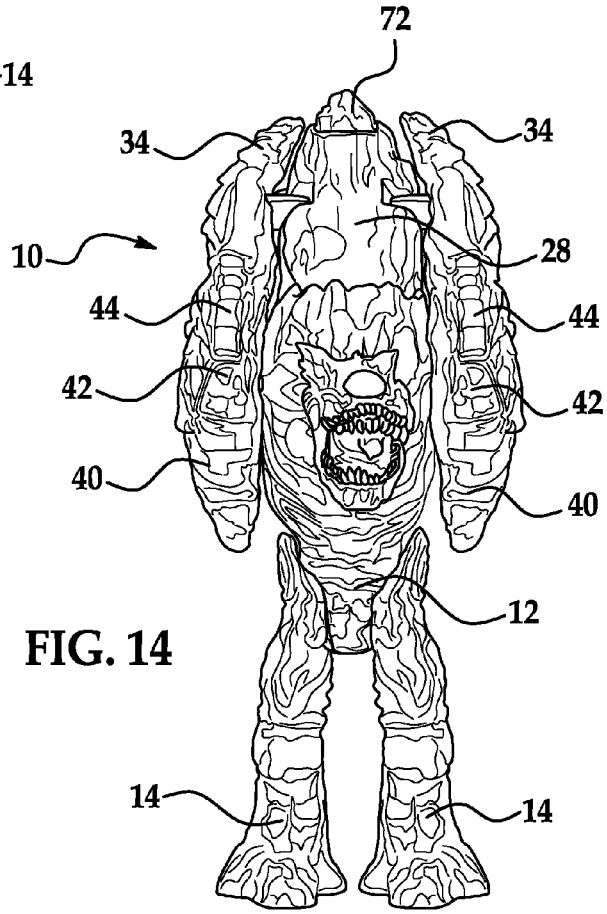
Figure 15:
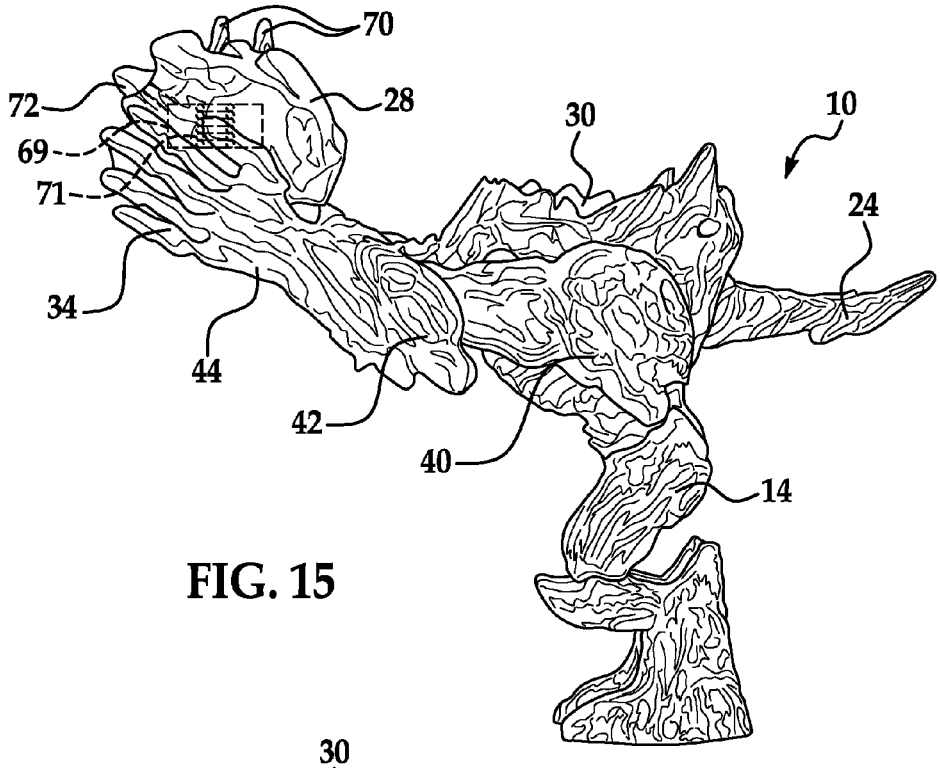
Figure 16:
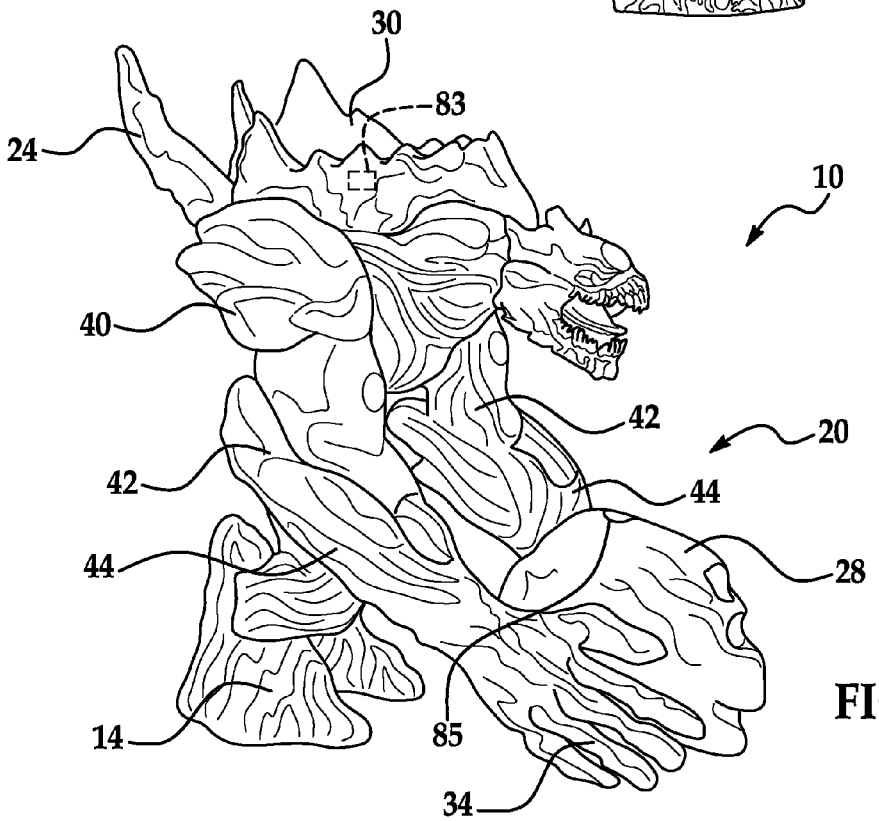

Referring now to FIGS. various exemplary embodiments of the present invention are provided. As illustrated, a toy FIG. 10 is described herein. In accordance with exemplary embodiments of the present invention portions of the toy as described herein may be formed out of an easily molded material such as plastic or any other equivalent materials. As will be further discussed herein, the toy has various embodiments or combinations wherein the toy figure moves or sequences through a plurality of positions through rotating and/or moving portions of the figure.

Figure 1A:
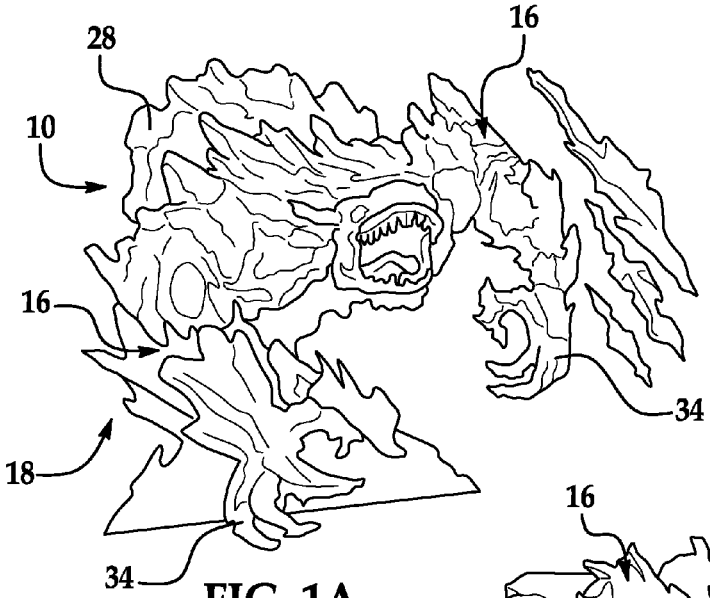
FIG. 1A is a perspective view of a toy in accordance with one exemplary embodiment of the present invention in a first position with a removable body portion secured thereto.
Figure 1B:
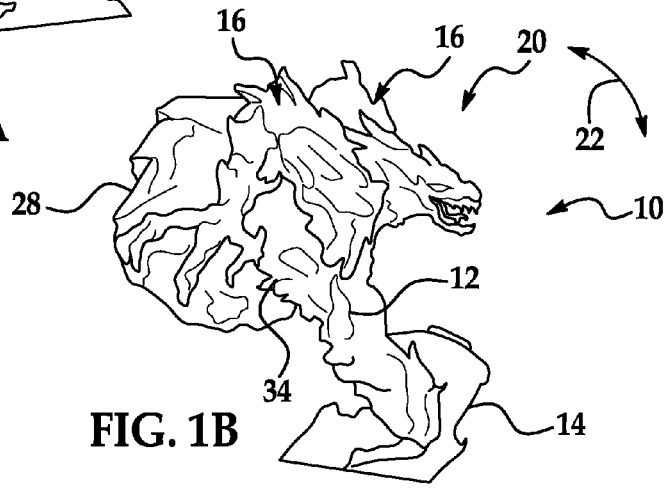
FIG. 1B is a view of the toy in a second position wherein arms of the toy grasp the removable body portion.
Figure 1C:
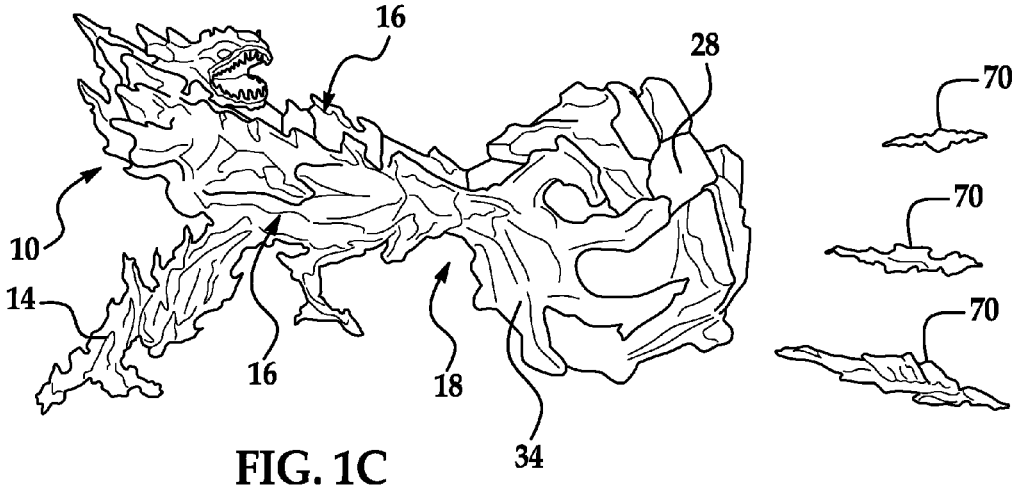
FIG. 1C is a view of a toy illustrating removal of the removable body portion.
Figures 2A, 2B, 2C:
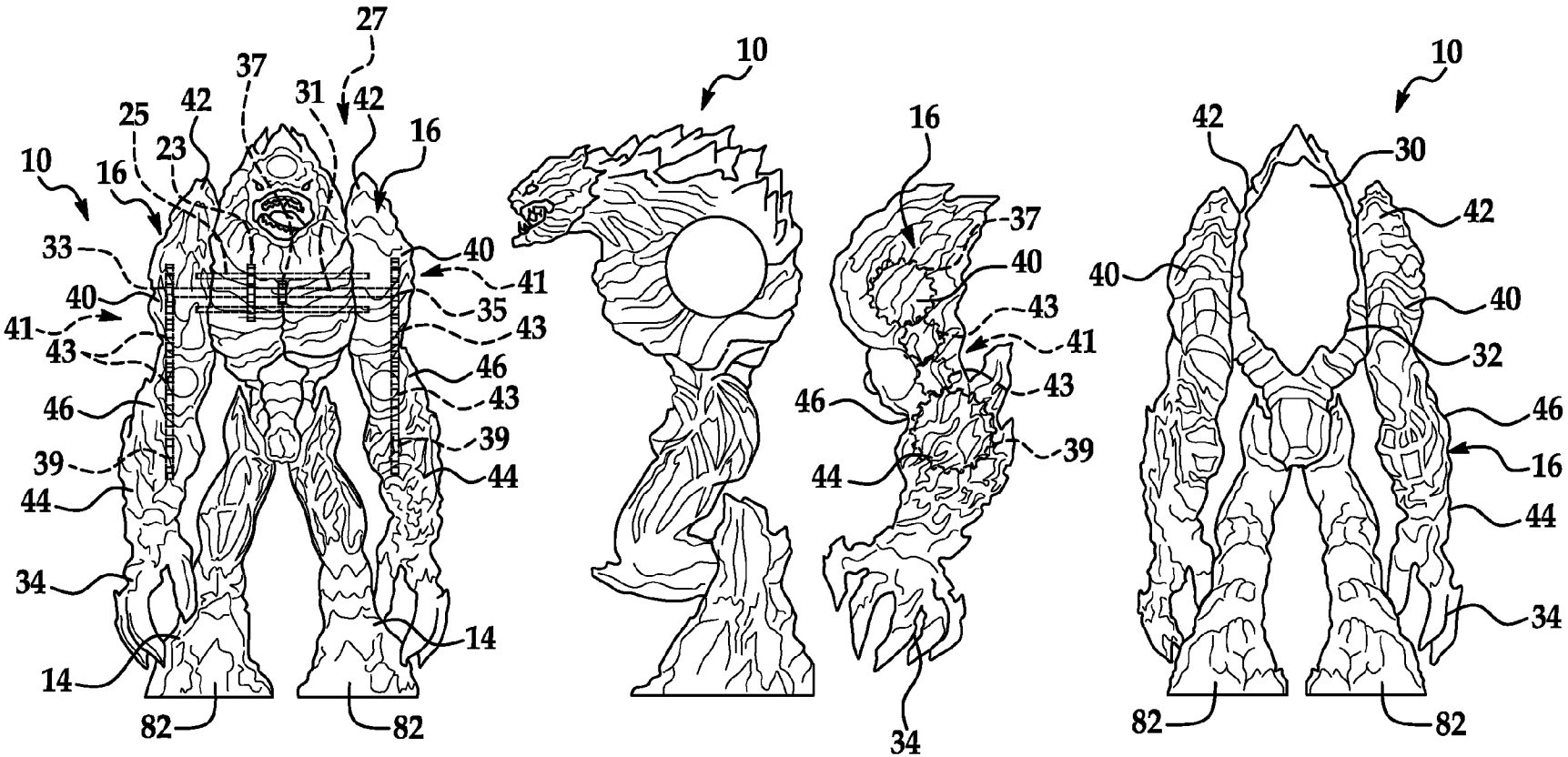
FIGS. 2A-2C are views illustrating the toy in accordance with one exemplary embodiment of the present invention.
Figure 3:
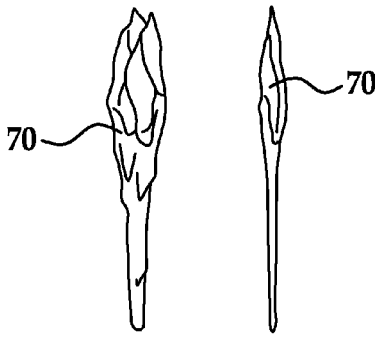
FIG. 3 illustrates projectiles capable of being launched from the removable body portion.
Figure 4:
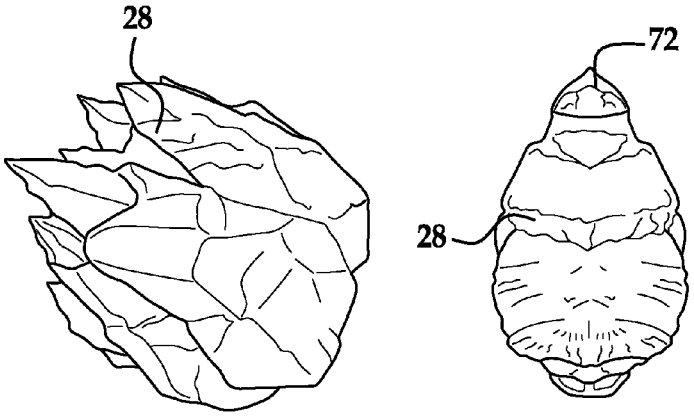
FIG. 4 illustrates the removable body portion in accordance with an exemplary embodiment of the present invention.

In one embodiment, the toy figure will resemble a creature, alien, human, humanoid, robot, character or any other type of configuration. Toy FIG. 10 has a main body portion 12 and a pair of legs 14 and a pair of arms or appendages 16. The pair of appendages or arms are movably or rotatably secured to the main body portion for movement from a first position 18 (see at least FIGS. 1A, 6 and 10) to a second position 20 (see at least FIGS. 1B and 7) and back to the first position 18 (see at least FIGS. 1C and 10) thus allowing for movement in the directions of arrows 22.

In one exemplary embodiment and in order to facilitate movement of the arms or appendages a handle portion 24 is disposed on a rear or back portion of the figure wherein the handle portion is easily grasped and manipulated by a user 26 of the toy. The handle portion is configured to manipulate the pair of appendages or arms though the positions described above and illustrated in the attached FIGS. as the same is manipulated by the user.

In accordance with one non-limiting exemplary embodiment and in order to facilitate movement the arms or appendages with respect to the main body portion the handle portion provides or is coupled to a drive mechanism 27 for rotating and/or moving the arms. The drive mechanism couples the arms to handle portion such that movement of the handle portion moves the arms.

In one embodiment and in order to assist in facilitating the movement of the arms back and forth through the positions illustrated in the FIGS. the arms are spring biased into the first position by a spring or springs disposed in the arms and/or the main body portion such that movement of the arms into the second position by movement of the handle portion and the subsequent release thereof will cause the arms to move back to the first position. Of course, various embodiments of the invention contemplate non-spring biased arms and body portions as well.

For example and as will be described herein the handle portion 24 is coupled to a gear train that actuates or moves a rack in a reciprocating fashion such that the arm members of the toy are articulated between the first and second positions as complementary gear trains disposed therein are also actuated by movement of the rack.

The toy figure also has a removably body portion 28 that is configured to be removably secured to the main body portion. The removable body portion is configured to be releasably retained in a cavity or recessed area 30 disposed on a rear area or back 32 of the toy figure. In one embodiment, the removable body portion is configured to be releasably retained in the cavity or recessed area 30 by interference or snap fit. In one implementation, the recessed area 30 has a feature 83 that is configured to engage a complementary opening 85 in removable body portion 28. Alternatively, the removably body portion is simply placed within recessed area 30.

In one embodiment, the arms will grasp the removable body portion as they are moved from the first position to the second position and when the removable body portion is placed in recessed area 30. In order to grasp the removable body portion each arm will comprise a hand portion 34 configured to engage features on a surface of the removable body portion such that once the arms are moved to the second position and when the removable body portion is in the recessed area the hands will grasp the removable body portion such that subsequent movement of the arms towards the first position from the second position will cause the removable body portion to be removed from area 30.

In order to facilitate the movement of the arms back and forth from the first position to the second position and to grasp the removable body portion, each arm 16 will have an upper arm portion 40 movably secured to the main body portion at a joint 42. In addition, upper arm portion 40 will have a lower arm portion or forearm portion 44 movably or pivotally secured to the upper arm portion 40 at a joint 46 in order to allow rotational or pivotal movement of the lower arm portions with respect to the upper arm portions in the direction of arrows 50 during movement of the arms between the first position and the second position as clearly illustrated in at least FIGS. 6-9. As illustrated, each hand potion 34 is secured to a distal end of lower arm portion 44.

In an alternative exemplary embodiment and in order to assist in the grasping of the removable body portion by the hand portions, the arms of the figure are configured for inward and outward movement with respect to each other and the arms may be spring biased slightly inwardly towards each other such that as the arms move to the second position, the hand portions will engage the removable body portion and the exterior surface of the removable body portion will bias the arms outwardly such that there is an engagement (e.g., frictional or otherwise) of the removable body portion by the hand portions as they move towards the first position from the second position. Alternatively, the arms may simply be configured to grasp the removable body portion. In yet another alternative, portions of the lower arm portion 44 are slidably secured to the upper arm portion 40 such that as the upper and lower arm portions move towards the first position the lower arm portion extends away from the upper arm portion. In yet another alternative, lower arm portion 44 may comprise two sections wherein one section extends from another one thus providing an extendable arm portion as the same moves from the second position to the first position. Thereafter and as the arm portions move from the first position back to the second position the extendable sections will retract and arm portion 44 will retract to an un-extended configuration.

Still further and in yet another alternative embodiment and as illustrated in FIGS. 11-16 the hand portions of the arms are fixedly secured to the removable portion such that movement of the arms from the first position to the second position will move the removable portion accordingly.

In accordance with an exemplary embodiment of the present invention, the toy figure has a launching mechanism 69 for launching at least one or a plurality of projectiles 70 from the removably body portion. Here the projectiles are simply loaded or inserted into a cavity in the removable body portion in order to compress a spring 71 of the launching mechanism until the mechanism, catch or any other suitable mechanism releasably engages and retains the spring 71 in a compressed state as well as a portion of the projectile therein until an actuating button 72 disposed on a surface of the removably body portion is depressed. Once the actuating button is depressed the catch of the spring mechanism is released and the compressed spring is allowed to expand thereby launching the projectiles from the removable body portion. Of course, any suitable or equivalent launching mechanism is contemplated to be used in accordance with exemplary embodiments of the present invention as long as the launching mechanism launches projectiles 70 from the removable body portion 28 as it is moved with the arms to the first position.

Accordingly and in one embodiment, the removable body portion is placed in area 30 with the projectiles inserted therein and as the arms move from the first position to the second position the removable body portion is grasped by the hand portions and removed from the main body portion and carried with the arms to second position wherein the actuating button 72 is depressed and the projectiles are launched from the removable body portion.

Figure 6:
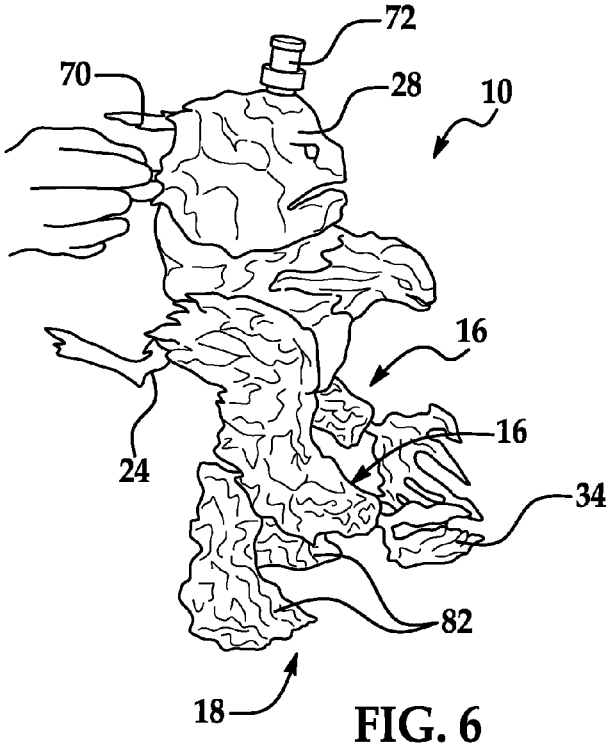
FIGS. 6-10 are views illustrating operational features and movement of the toy figure in accordance with exemplary embodiments of the present invention.
Figure 6A:
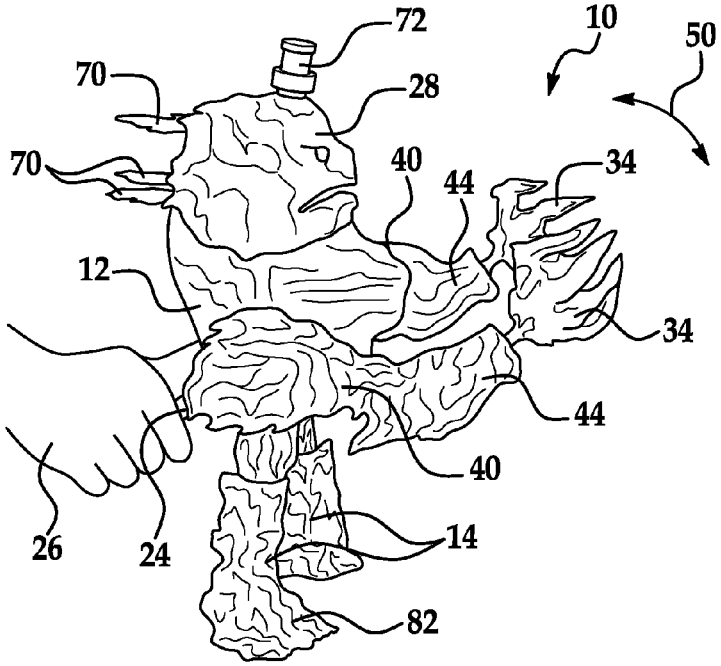
Figure 7:
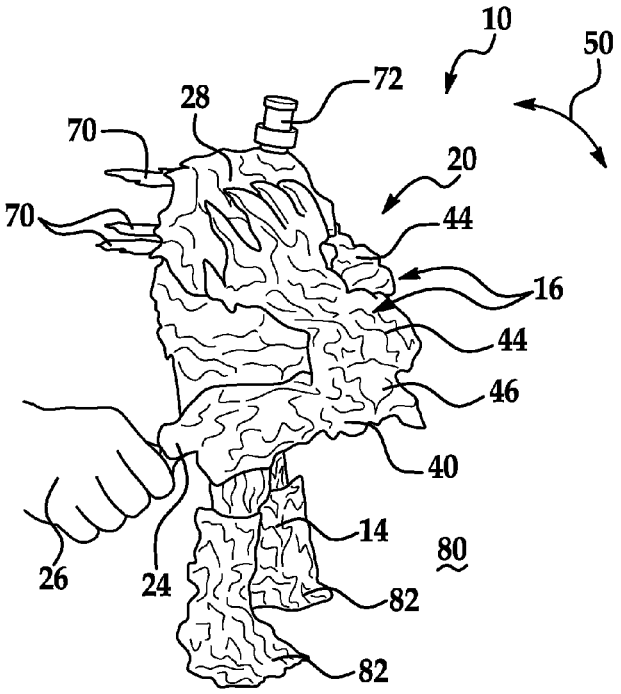
Figure 8:
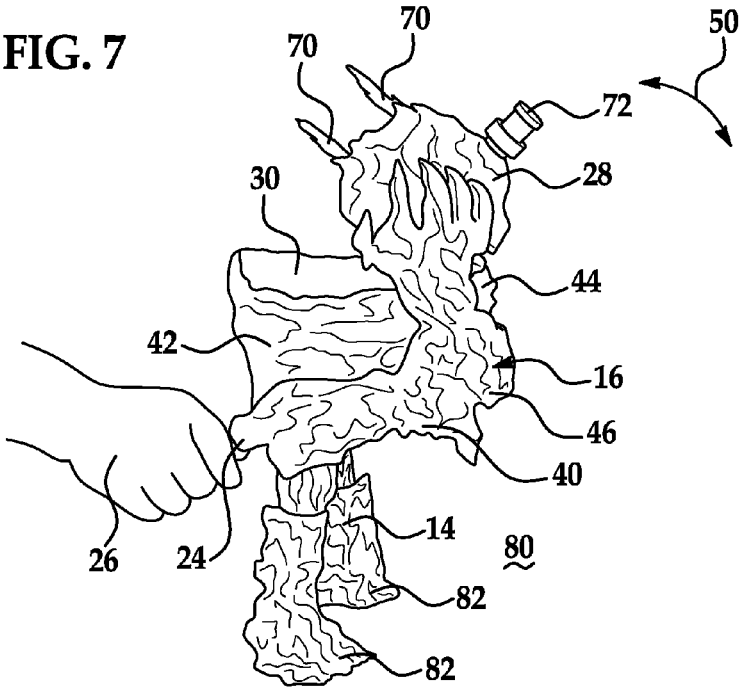
Figure 9:
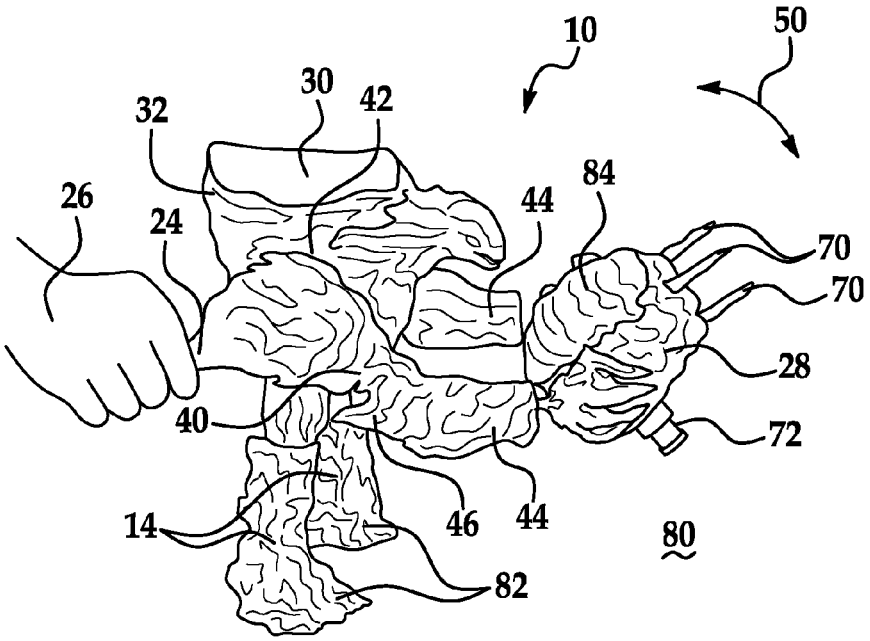

As illustrated in FIGS. 6-10, the removable body portion is inverted such that the actuating button rotates from an upright position illustrated at least in FIGS. 6 and 7 to a downward facing position (see at least FIGS. 9 and 10) wherein actuating button 72 is depressed by a surface 80 the figure is standing on as the arms with the removable body portion translates to the first position. In an exemplary embodiment, the legs of the figure have foot portions 82 configure to support it on surface 80 and the toy figure (e.g., arms, removable body portion, actuating button, etc.) is configured such that once removable body portion 28 is moved by the arms to the first position actuation button 72 is depressed by surface 80 and the projectiles are launched.

Figure 5:
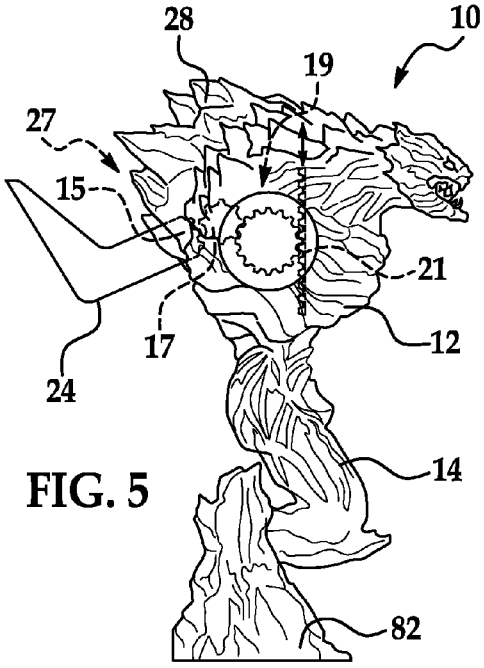
FIG. 5 is a side view of the toy figure with the removable body portion secured thereto and without the toy figures arms secured thereto.
Figure 5A:
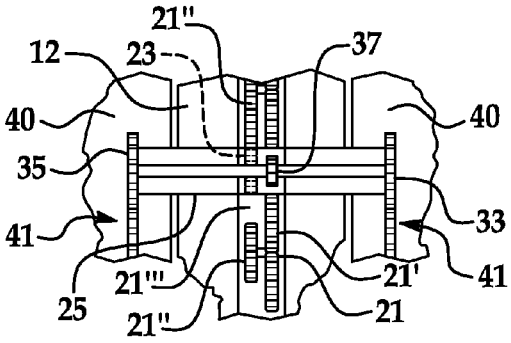
FIG. 5A is a view of portions of a drive mechanism in accordance with an embodiment of the present invention.

In one embodiment and as illustrated, the toy figure is configured as creature or character and the main body portion is configured to have a distinct characteristic and the removably body portion also has a configuration that matches the distinct characteristic. Also and in one non-limiting embodiment, the removable body portion is configured to resemble a rock or boulder. Furthermore and as illustrated in at least FIGS. 8-10 the inner surface of area 30 has a different color than other portions of the figure and a bottom surface 84 of the removable body portion is configured to match the inner surface of area 30. Moreover and when the removable body portion is moved by the arms to the first position the bottom surface of the removable body portion is now upwardly facing for ease of view as well as the inner surface of area 30 providing an aesthetically pleasing play feature. In accordance with one exemplary embodiment of the present invention, the removable body portion may be placed rearwardly on the figure's/creature's back (see at least FIG. 5) such that the same looks like a portion of the creature's back.

Referring to FIGS. 2A-2B, 5 and 5A a non-limiting example of drive mechanism 27 is illustrated. Here an end portion 15 of the handle portion 24 is configured to have a geared surface 17 that is received within the body portion. In addition, the handle portion 24 is pivotally secured to the body portion such that the handle portion can be moved upward and downward with respect to the body portion by a user. As the handle portion moves upward and downward the geared surface 17 engages and rotates a plurality of gears of a gear train 19 that is rotatably received within the body portion.

The drive mechanism 27 also includes comprises a rack member 21 that is slidably disposed within the main body portion of the toy figure. In one embodiment, the rack includes a pair of geared surfaces 21' and 21" one of which (21') is configured to constantly engage a gear of gear train 19 as it rotates thus, the rack slides up and down as the gear train 19 is rotated by movement of the handle portion 24 while, the other one of the pair of geared surfaces (21") of the rack is configured to intermittently engage a gear 23 portion fixedly secured to a shaft 25 rotatably received within the main body portion of the toy figure. This intermittent contact with shaft 25 will cause the desired movement of arm members 40 with respect to the main body portion while also allowing for movement of arm members 44 with respect to arm members 40 as will be discussed below. In addition, gear train 19 is configured to independently cause movement of rack 21 via movement of handle 24 and movement of rack 21 will cause movement of arm members 40 and 44 via separate interaction with rack 21 as will be discussed below.

Drive mechanism 27 also includes a shaft member 31 rotatably received within shaft 25. Shaft member 31 has a pair of gears 33, 35 and a gear 37 fixedly secured thereto. Gear 37 is fixedly secured to shaft member 31 between gears 33 and 35 or in other words, gears 33 and 35 are fixedly secured to the ends of shaft 31 while gear 37 is disposed therebetween. Shaft 25 is configured such that gear 37 will engage geared portion 21' of the rack when shaft is rotated to a position corresponding to the upper arm members 40 being proximate to the second position such that linear movement of the rack will cause the appropriate rotational movement gear 37 and ultimately shaft 31 as well as gears 33 and 35 coupled thereto, when the arm members 40 are rotated into a position corresponding to the second position movement of rack 21 will cause movement of arm members 44 with respect to arm members 40 between the position illustrated at least in FIGS. 14 and 15 as well as an intermediary position.

The rotational movement of shaft 31 and gears 33 and 35 will cause pivotal movement of arm members 44 with respect to arm members 40. This is achieved by arm member 44 being pivotally secured to arm member 40 and wherein a gear member 39 is located at the point of pivotal securement of arm member 44 to arm member 40.

Still further, a gear train 41 comprising a plurality of gears 43 are rotatably received within each arm member 40 and couple each arm member 44 to a respective one of the gears 33, 35 fixedly secured to shaft 31 such that rotational movement of shaft 31 will cause pivotally movement of arm member 44 with respect to arm member 40. Accordingly and as illustrated in the figures, reciprocal movement of handle portion 24 will cause the arm members 40, 44 to move between the first position and the second position wherein removable object 28 is also moved between the first position and the second position.

Accordingly, and as the rack moves up and down shaft 25 will rotate due to gear portion 23 engaging one of the geared surfaces of the rack. Each end of shaft 25 is fixedly secured to an upper arm portion 40 such that rotational movement of shaft 25 will cause arm members 40 to move between the first position and the second position. In one embodiment and in order to provide the desired movement of the upper arm members with respect to the main body portion geared surface 21" has a gap 21' such that movement of the rack upward will cause the arm members 40 to move upward until a point where the gap is adjacent to geared portion 23 thereafter, further interaction with geared portion 23 is prevented while rack 21 can continue upwardly and at this point and due to the configuration of shaft 25 geared surface 21' will now contact and rotate gear 37 which causes pivotal movement of the arm members 44 with respect to arm members 40 via gear train 41.

Downward movement of or opposite movement of rack 21 from this position will cause movement of shaft 31 in an opposite direction and thus arms 44 will move in a corresponding direction with respect to arm 40 and geared portion 21" will once again contact geared portion 23 and rotate shaft 25 in an opposite direction via interaction with geared portion 21" and 23 thus disengaging geared portion 21' from gear 37 and also causing rotational movement of arm members 40 with respect to the main body portion 12 in an opposite direction via rotation of shaft 25.

This rotational movement of shaft 25 will cause gear 37 of shaft 31 to no longer engage geared surfaces 21' due to the configuration of shaft 25 and its rotational movement caused by geared surfaces 21".

Accordingly, rotational movement of shaft 25 causes movement of arm members 40 while independent movement of shaft 31 causes rotational movement of arm members 44 with respect to arm members 40. Still further, linear movement of rack 21 via gear train 19 causes the rotational movement of shafts 25 and 31, wherein one of the geared surfaces of the rack is configured to have a gap such that intermittent contact is made with a complementary geared surface of shaft 25 and shaft 25 is configured such that gear 37 of shaft 31 is only rotated by the rack once shaft 25 is rotated into a specific orientation with respect to rack 21. In other words, movement of the rack in a first direction will cause rotational movement of shaft 25 in a first direction until the geared portion 23 of shaft 25 no longer makes contact with the geared portion 21" of the rack and shaft 25 is then orientated such that geared portion 21' will now rotate gear 37 rotatably received within shaft 25, which ultimately causes arm members 44 to move with respect to arm members 40. Thereafter opposite movement of the rack will cause opposite movement of arm members 44 with respect to arm members 40 via geared portion 21' engaging gear 37 and then as geared portion 21" is in a position to reengage geared portion 23 shaft 25 will once again rotate and the configuration of shaft 25 will prevent rotational movement of shaft 31.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy figure, comprising:

a main body portion;

a pair of appendages movably secured to the main body portion for movement from a first position to a second position and back to the first position; and a removable body portion removably secured to the main body portion, wherein the pair of appendages grasp the removable body portion when they are moved to the second position and wherein the removable body portion is removed from the main body portion by the pair of appendages as they are moved back towards the first position from the second position, wherein the removable body portion further comprises a launching mechanism for launching at least one projectile from the removable body portion.

2. The toy figure as in claim 1, wherein the removable body portion further comprises an actuating button disposed on a surface of the removable body portion, wherein the actuation button is depressed when the pair of appendages are in the first position.

3. The toy figure as in claim 1, wherein the removable body portion further comprises an actuating button disposed on a surface of the removable body portion, the actuating button being configured for actuating the launching mechanism in order to launch the at least one projectile from the removable body portion.

4. The toy figure as in claim 3, wherein the actuating button is depressed when the pair of appendages are moved back towards the first position from the second position and the actuating button contacts a surface the toy figure is placed on.

5. The toy figure as in claim 1, wherein the main body portion is configured to have a distinct characteristic and the removable body portion has a configuration that matches the distinct characteristic.

6. The toy figure as in claim 1, wherein the main body portion has a receiving area into which the removable body portion is received and the main body portion is configured to have a distinct characteristic and wherein the removable body portion has a configuration that matches the distinct characteristic.

7. A toy figure, comprising:

a main body portion;

a pair of arms movably secured to the main body portion for movement between a first position and a second position, each of the pair of arms having an upper arm portion pivotally secured to the main body portion and a pair of lower arm portions each being pivotally secured to the upper arm portion; and a removable body portion fixedly secured to the pair of arms, the removable body portion being configured to be received within an area of main body portion when the pair of arms are in the second position and wherein the removable body portion is removed from the main body portion when the pair of arms are in the first position, wherein the removable body portion further comprises a launching mechanism for launching at least one projectile from the removable body portion, when the pair of arms are in the first position.

8. The toy figure as in claim 7, wherein the removable body portion further comprises an actuating button disposed on a surface of the removable body portion, wherein the actuation button is depressed when the pair of arms are in the first position.

9. The toy figure as in claim 8, wherein the actuating button rotates from an upright position when the pair of arms are in the second position to a downward facing position when the pair of arms are in the first position and the actuating button is depressed by a surface the toy figure is standing on when the pair of arms are in the first position and the toy figure further comprises a pair of legs each having a foot portion configure to support it on the surface.

10. The toy figure as in claim 7, wherein the toy figure further comprises a drive mechanism coupled to a handle portion pivotally secured to the main body portion.

11. The toy figure as in claim 10, wherein an end portion of the handle portion is configured to have a geared surface that is received within the main body portion and as the handle portion moves with respect to the main body portion the geared surface engages and rotates a plurality of gears of a gear train that is rotatably received within the main body portion and movement of the plurality of gears causes the arms to move between the first position and the second position.

12. The toy figure as in claim 11, wherein the drive mechanism further comprises a rack member that is slidably disposed within the main body portion of the toy figure, wherein the rack member has a pair of geared surfaces, one of which is configured to engage one of the plurality of gears of the gear train causing the rack to slide up and down as the gear train is rotated by movement of the handle portion.

13. The toy figure as in claim 12, wherein the other one of the pair of geared surfaces of the rack engages a gear portion fixedly secured to a first shaft rotatably received within the main body portion of the toy figure, wherein each end of the first shaft is fixedly secured to one of the pair of upper arm portions such that rotational movement of first shaft will cause the pair of arm members to move between the first position and the second position.

14. The toy figure as in claim 13, wherein the drive mechanism further comprises a second shaft member rotatably received within the first shaft and wherein the second shaft is coupled to a pair of gear trains disposed in the pair of arms, wherein movement of the second shaft rotates the pair of gear trains and movement of the pair of gear trains causes the lower arm members to move with respect to the upper arm members and wherein the second shaft member is coupled to one of the pair of geared surfaces such that movement of the one of the pair geared surfaces causes rotational movement of the second shaft.

15. The toy figure as in claim 11, wherein the removable body portion further comprises an actuating button disposed on a surface of the removable body portion, wherein the actuation button is depressed when the pair of arms are in the first position.

16. The toy figure as in claim 15, wherein the actuating button rotates from an upright position when the pair of arms are in the second position to a downward facing position when the pair of arms are in the first position and the actuating button is depressed by a surface the toy figure is standing on when the pair of arms are in the first position and the toy figure further comprises a pair of legs each having a foot portion configure to support it on the surface.

* * * * *